United States Patent [19]

Koland

[11] 4,437,205

[45] Mar. 20, 1984

[54] VACUUM CLEANER NOZZLE LIFT DEVICE

[75] Inventor: David G. Koland, Sandstone Township, Pine County, Minn.

[73] Assignee: Whirlpool Corporation, Benton Harbor, Mich.

[21] Appl. No.: 357,135

[22] Filed: Mar. 11, 1982

[51] Int. Cl.[3] ..... A47L 5/34

[52] U.S. Cl. ..... 15/354

[58] Field of Search ..... 15/354, 355, 356

[56] References Cited

U.S. PATENT DOCUMENTS

| | | | |
|---|---|---|---|
| 2,067,990 | 1/1937 | Taylor | 15/354 X |
| 2,734,217 | 2/1956 | Brace | 15/354 X |
| 3,217,351 | 11/1965 | Hayba . | |
| 3,608,333 | 9/1971 | Selley et al. | 15/354 X |
| 3,654,661 | 4/1972 | Scott . | |
| 3,909,874 | 10/1975 | Clowers et al. . | |
| 3,936,903 | 2/1976 | Johnson . | |
| 4,199,839 | 4/1980 | Martinec . | |

*Primary Examiner*—Chris K. Moore

*Attorney, Agent, or Firm*—Wood, Dalton, Phillips, Mason & Rowe

[57] ABSTRACT

A vacuum cleaner nozzle lift device for adjustably raising the front portion of the nozzle. The device includes a U-shaped front wheel assembly including a support having a rear bight pivotally mounted to the nozzle housing, a pair of forwardly extending legs, and wheels rotatably carried on the forward distal end portions of the legs. The front wheel height adjuster includes a lifter slidably embracing a leg of the support forwardly of the bight, the lifter being mounted to a rear portion of the housing adjacent the bight, a cam follower movable with the lifter, and a cam movably carried by the housing for camming engagement with the cam follower. A user-operated foot pedal selectively moves the cam against the cam follower for correspondingly swinging the support about the axis of the bight to selectively raise and lower the front wheels and thereby adjust the angular disposition of the nozzle housing relative to the subjacent surface.

16 Claims, 7 Drawing Figures

FIG. 1
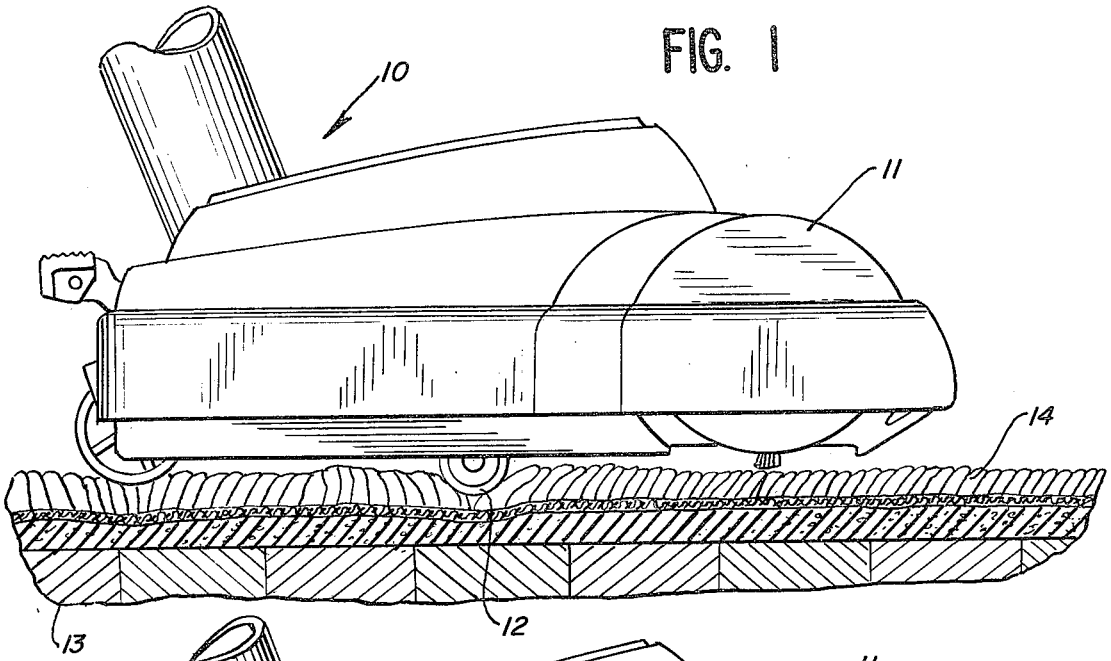
FIG. 2
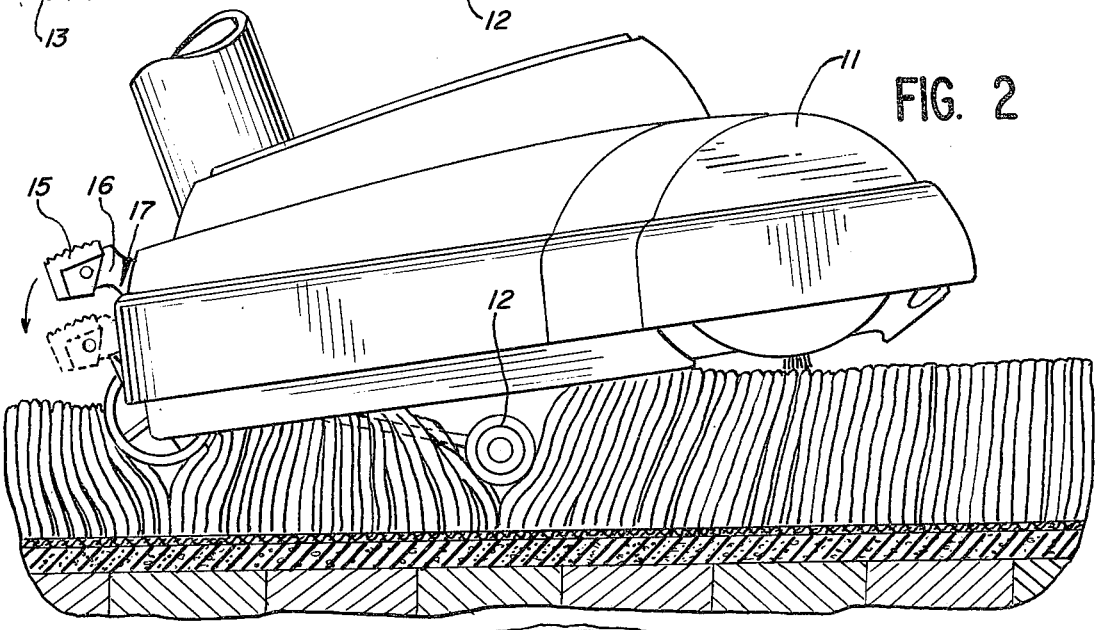
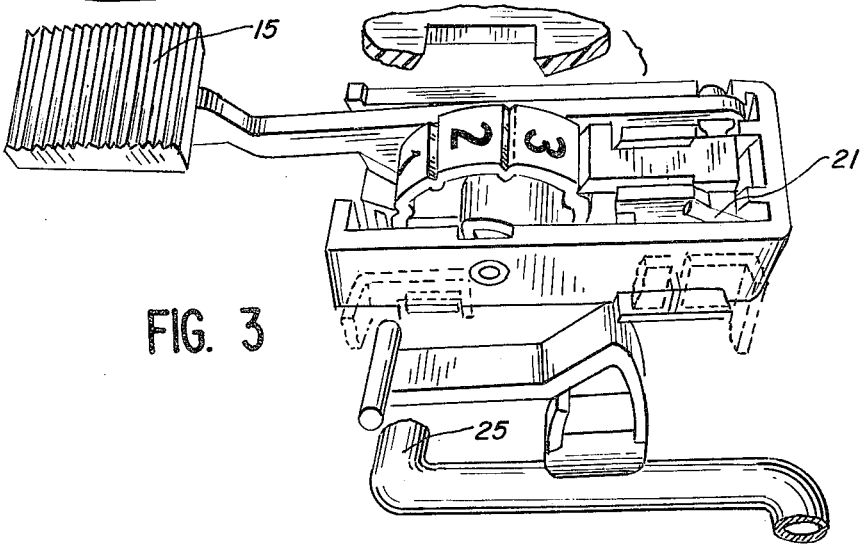
FIG. 3

VACUUM CLEANER NOZZLE LIFT DEVICE

BACKGROUND OF THE INVENTION

1. Field of the Invention

This invention relates to vacuum cleaner structures and in particular to means for adjustably raising the front portion of the vacuum cleaner nozzle such as for use with different pile height carpets.

2. Description of the Background Art

In U.S. Pat. No. 3,346,896 of Daniel A. Arones, a scrubber machine is provided having mechanism for swinging front wheels thereon on a pivot so as to adjustably raise and lower the front portion of the apparatus. The mechanism includes a wheel which runs along a lever in effecting the desired adjustment.

Dewey M. Dow discloses in U.S. Pat. No. 2,104,453, a vacuum cleaner construction wherein a number of different forms of wheel height adjustment means are provided wherein the rear wheels of the vacuum cleaner are swung on a pivot by the different adjusting means.

In U.S. Pat. No. 2,741,488, Melvin H. Ripple discloses a vacuum cleaner utilizing a variable radius cam which is rotated incrementally by actuation of a foot pedal. In operation, the user depresses the foot pedal to raise the cam to a free position with a pawl engaging the next tooth for presetting a recess to receive a shaft end arranging the nozzle in a new desired position. Repeated reciprocation of the lever is continued until the nozzle adjustment desired is reached.

SUMMARY OF THE INVENTION

The present invention comprehends an improved vacuum cleaner nozzle adjusting means which is extremely simple and economical of construction while yet providing an improved positive facilitated adjustment of the nozzle height.

More specifically, the invention comprehends the provision of such a front wheel height adjusting means for use in a vacuum cleaner nozzle structure including a lifter slidably embracing a leg of a front wheel support, the support having a rear bight, means movably mounting the lifter to a rear portion of the housing spaced adjacent the support bight, means movable with the lifter defining a cam follower, cam means movably carried by the housing for camming engagement with the cam follower, user-operated means selectively moving the cam means against the cam follower correspondingly swinging the support about the axis of the bight to selectively raise and lower the front wheels and thereby adjust the angular disposition of the nozzle housing relative to the subjacent surface.

Operation of the apparatus may be effected by a foot pedal engaged by the user sequentially to raise the front portion of the nozzle incrementally as desired.

The lifter, in the illustrated embodiment, is defined by a U-shaped portion slidable longitudinally on the front wheel support leg to permit movement therealong in the event a substantial force is placed on the nozzle.

In the illustrated embodiment, the cam means is arranged to be spaced from the cam follower suitably to permit the nozzle to be disposed in a lowermost position. In the illustrated embodiment, the cam means is arranged to provide two series of similar adjustments of the nozzle height for each 360° rotation of the cam.

More specifically, in the illustrated embodiment, the operating means defines a ratchet means comprised of a lever pivotally mounted to the housing and having a foot pedal actuation portion, a ratchet wheel rotatably mounted to the housing and having notches and ratchet teeth, a cam rotatable with the ratchet wheel, means responsive to a depression of the foot pedal actuation portion of the lever for selectively engaging the ratchet teeth to advance the ratchet wheel a rotational step as an incident of each depression of the foot pedal actuation portion, and a cam follower connected to the lifter for selectively moving the lifter in accordance with the rotational position of the cam.

The cam causes the cam follower to move the lifter incrementally to provide a plurality of successively greater wheel height adjustments and a subsequent return to a minimum wheel height adjustment as a result of step-by-step rotation advance of the ratchet wheel by the foot pedal actuation portion of the lever.

Means are provided for releasably retaining the ratchet wheel in each of the successive advance rotational positions thereof and, in the illustrated embodiment, the retaining means includes a resilient tooth releasably engaging the notches of the ratchet wheel.

The ratchet teeth, in the illustrated embodiment, comprise teeth projecting parallel to the axis of rotation of the ratchet teeth and the means responsive to depression of the lever include second teeth having releasable sliding engagement with the ratchet teeth and means for resiliently biasing the second teeth toward the ratchet teeth.

BRIEF DESCRIPTION OF THE DRAWING

Other features and advantages of the invention will be apparent from the following description taken in connection with the accompanying drawing wherein:

FIG. 1 is a fragmentary side elevation of a vacuum cleaner structure having new and improved wheel adjusting means embodying the invention;

FIG. 2 is a side elevation similar to that of FIG 1, but illustrating the arrangement of the wheel adjusting means positioning the front end of the nozzle in an elevated disposition;

FIG. 3 is a fragmentary perspective view illustrating portions of the different elements forming the height adjusting means;

DESCRIPTION OF THE PREFERRED EMBODIMENT

Figure 4:
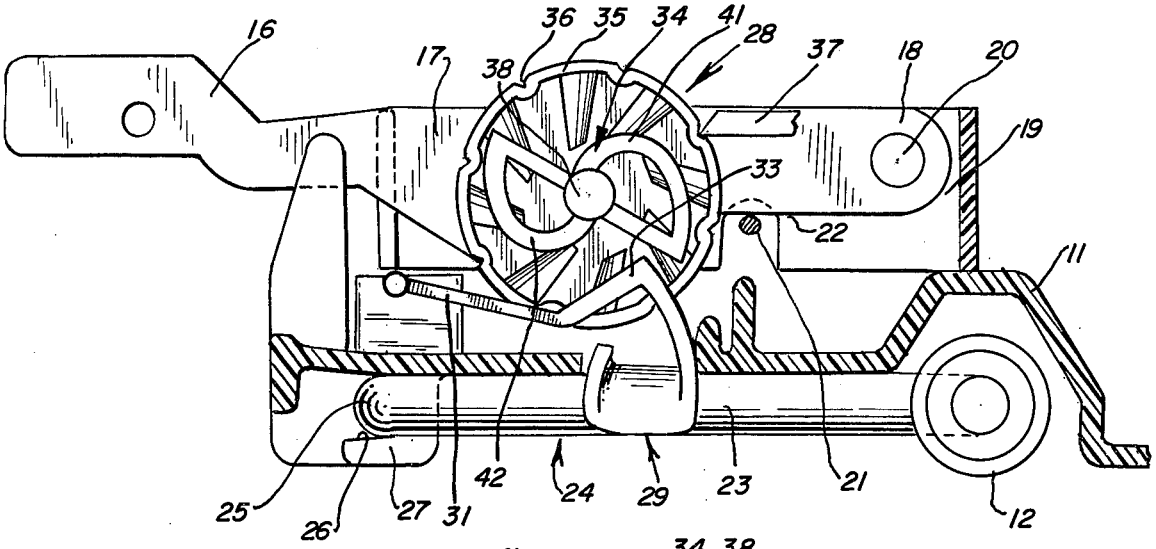
FIG. 4 is a fragmentary vertical section illustrating the arrangement of the height adjusting means in the lowermost disposition thereof.

In the exemplary embodiment of the invention as disclosed in the drawing, a vacuum cleaner structure generally designated 10 includes a nozzle housing 11 having front wheels 12 and rear wheels 13 for rolling movement of the vacuum cleaner structure on a subjacent surface, such as carpet 14, as shown in FIG. 1. The present invention is concerned with means for moving the front wheels 12 vertically relative to the nozzle so as to selectively position the nozzle in any one of a plurality of different angularly elevated positions, such as the position illustrated in FIG. 2.

In the illustrated embodiment, adjustment of the height of the wheel 12 relative to the nozzle is effected by suitable operation of a foot pedal 15 provided on a rearwardly projecting end 16 of operating lever 17. As shown in FIG. 4, the front end 18 of the lever 17 is pivotally mounted to a portion 19 of the housing by a pivot 20. The lever is biased in a clockwise direction, as seen in FIG. 4, by a spring 21 acting on a bottom surface 22 of the lever.

As further illustrated in FIG. 4, front wheels 12 are mounted on the front distal ends of legs 23 of a U-shaped support 24 having a rear bight portion 25. The bight portion is pivotally mounted in a rearwardly opening recess 26 defined by a C-shaped portion 27 of the housing. Thus, the front wheel 12 may swing about the axis of the bight portion 25 as between the minimum high position of FIG. 4 and the elevated position of FIG. 5. The present invention is concerned with the provision of means for effecting selective incremental positioning of the front wheels 12 between the lowered position of FIG. 4 and raised position of FIGS. 2 and 5.

More specifically, the lifting mechanism generally designated 28 (FIG. 4) includes a lifter generally designated 29, having a portion 30 bodily translatably engaging, and more specifically slidably embracing, the wheel support leg 23 forwardly of the bight portion 25. The lifter further includes a connecting portion 31 having a distal, somewhat cylindrical rear portion 32 pivotally mounted in rounded notches formed in the housing adjacent bight 25. The connecting portion further defines a cam follower 33.

Figure 7:
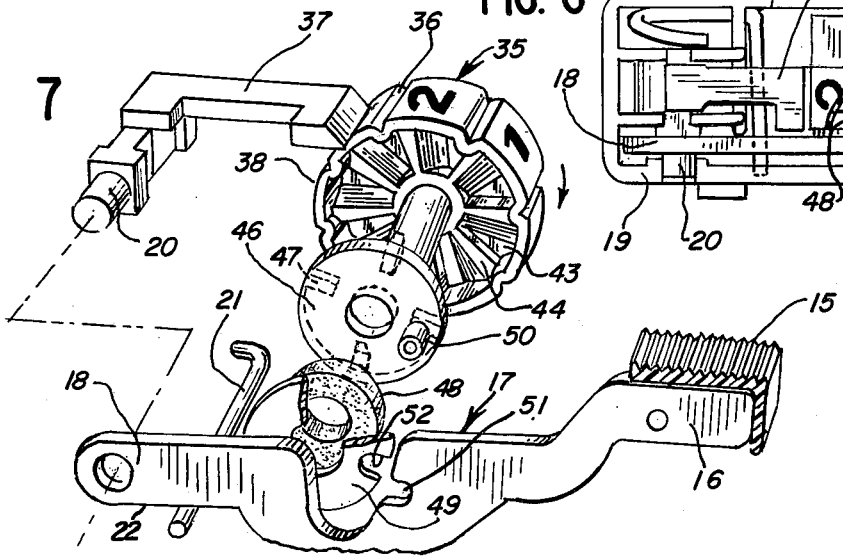
FIG. 7 is a fragmentary exploded perspective view illustrating in greater detail a portion of the structure of the height adjusting means, FIG. 7 being taken from a position opposite that of FIG. 3.

Movement of the lifter 29 is controlled by a cam generally designated 34 fixed for rotation to a ratchet wheel 35. The ratchet wheel is provided with a plurality of peripheral notches 36 selectively engaged by a resilient tooth member 37 having pivot 20 formed integrally therewith, as illustrated in FIG. 7. The ratchet wheel and cam are mounted for rotation on a shaft 38 carried in opposite support portions 39 and 40 of the housing.

Figure 5:
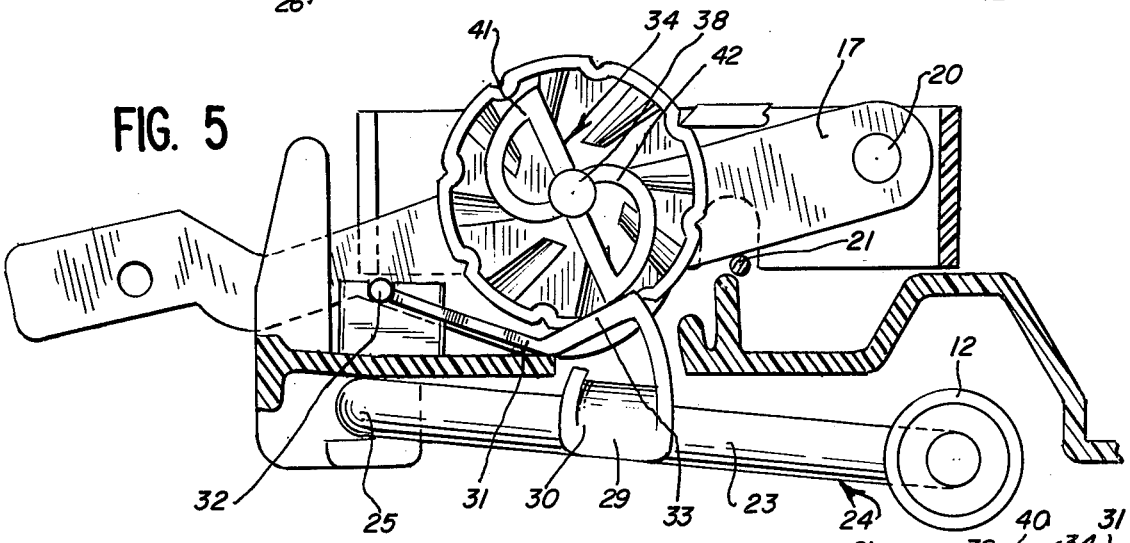
FIG. 5 is a fragmentary vertical section illustrating the arrangement of the height adjusting means in an elevated disposition such as that of FIG. 2.

As best seen in FIGS. 4 and 5, cam 34 includes a pair of diametrically opposite portions 41 and 42 which are spaced angularly apart about the axis of shaft 38. The cam portions 41 and 42 are similar in configuration and cause a sequential movement of the wheels 12 between the released position of FIG. 4 and the maximum raised position of FIG. 5 twice during each rotation of the cam 360° about the shaft axis.

Figure 6:
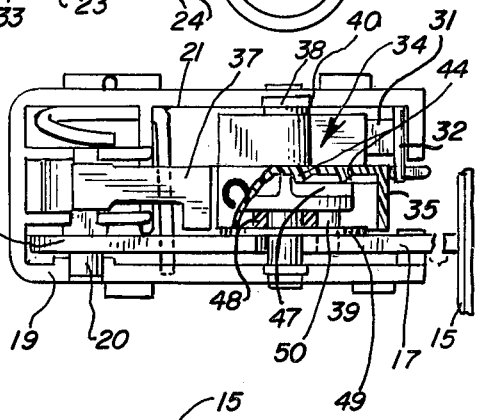
FIG. 6 is a fragmentary top plan view of the height adjusting structure.

As best seen in FIG. 7, the ratchet wheel is provided with a face portion 43 defining a plurality of axially projecting teeth 44 extending away from the axis of the shaft and being spaced circumferentially about the axis. An advancing wheel 46 is rotatably mounted on the shaft 38 and is provided with teeth 47 selectively engageable with the teeth 44 of ratchet wheel 35, as best seen in FIG. 6. The advancing wheel is resiliently biased toward the ratchet face portion 43 by spring means, such as spring washer 48, which illustratively may comprise an annular sponge element. A low friction washer 49 is disposed outwardly of the sponge spring 48 in facial engagement with the side of the lever 17, as seen in FIG. 6.

Advancing wheel 46 is provided with a cylindrical projection 50 received in a recess 51 of lever 17 and a complementary recess 52 in washer 49 cooperatively defining an opening receiving the cylindrical projection 50 for movement with the lever 17 as it is pivoted about pivot 20.

In operation, when the user depresses the foot pedal 15 with the lifting mechanism 28 arranged in the minimum height arrangement of FIG. 4, cylindrical projection 50 is urged in a clockwise direction, as seen in FIG. 7, whereby teeth 47 thereof engage teeth 44 of the ratchet wheel and move the ratchet wheel one step in a clockwise direction, as seen in FIG. 7. Such movement of the cam from the released position of FIG. 4 causes the cam portion 42 to engage the cam follower 33 of lifter 29, depressing the wheel support 23 a first incremental amount so as to lower the wheels 12 relative to the nozzle housing 11 and, thus, lift the front portion of nozzle housing 11 to a position intermediate that of FIGS. 1 and 2.

The ratchet wheel 35 is retained in the first rotated position by the resilient tooth member 37 engaging a notch 36 in the ratchet wheel periphery. Thus, the ratchet wheel is maintained in the first adjusted position while the foot pedal 15 is returned to the raised position of FIG. 4. from the lowered position of FIG. 5.

The lowering of the wheels is effected by the downward movement of the lifter portion 30 against the leg 23 of the wheel support. The lifter portion 30 has a longitudinally slidable engagement with the leg 23, however, so that it may slide along the leg in the event of inadvertent placing of a large force on the nozzle as by the user accidentally stepping thereon.

In the illustrated embodiment, the interengaging teeth 47 and 44 are arranged so as to provide four successive incremental angular adjustments of the support 24 by each of the cam portions 41 and 42. Thus, each time the foot pedal 15 is depressed, the incremental rotation of the cam causes a further lowering of the support end wheels 12 on the distal end thereof until the cam moves sufficiently to pass the end of the cam follower 33 whereupon the cam follower may move upwardly behind the cam, permitting the support to similarly move upwardly back to the lowermost position of FIG. 4.

Lifter portion 30 is snap-fitted to the leg 23 of support 24 and, thus, retains the front wheels 12 against free downward swinging movement in the event the nozzle is lifted from the floor surface.

Thus, the present invention comprehends an improved wheel adjustment structure including a lifter 29 embracing a leg 23 of the wheel support 24 with means 25 for movably mounting the lifter to a rear portion 27 of the nozzle housing spaced adjacent the support bight 25. The lifter further defines a cam follower 33 which is engaged by a cam 34 selectively positioned by operation of a foot pedal through a ratchet wheel 35 incrementally advanced by successive depressions of the foot pedal. The ratchet wheel is releasably retained in the adjusted position at the end of each incremental rotational step thereof. THe lifter includes a resilient connecting portion 31 permitting slidable movement of the embracing portion 30 along the leg 23 of the support for effectively preventing damage to the mechanism such as in the event the nozzle is stepped upon with the wheels in a lowered position.

Thus, the nozzle lifting mechanism of the present invention is extremely simple and economical of construction while yet providing facilitated positive adjustment of the nozzle for use in cleaning different floor surface materials such as low pile height carpeting and high pile height carpeting.

The foregoing disclosure of specific embodiments is illustrative of the broad inventive concepts comprehended by the invention.

I claim:

1. In a vacuum cleaner nozzle having a housing defining an air suction passage, rear wheels supporting a rear portion of the housing for rolling movement of the nozzle on a subjacent surface to be cleaned, and a U-shaped front wheel assembly including a support having a rear bight pivotally mounted to the housing, a pair of forwardly extending legs, and wheels rotatively carried on a forward distal end portion of said legs to rollingly engage the subjacent surface forwardly of said rear wheels, an improved frontwheel height adjuster comprising:

a lifter slidably embracing a leg of said support forwardly of said bight;

means movably mounting said lifter to a rear portion of the housing spaced adjacent said support bight;

means movable with said lifter defining a cam follower;

cam means movably carried by the housing for camming engagement with said cam follower;

user-operated means selectively moving said cam means against said cam follower for correspondingly swinging said support about the axis of said bight to selectively raise and lower the front wheels and thereby adjust the angular disposition of the nozzle housing relative to said subjacent surface.

2. The vacuum cleaner nozzle front wheel height adjuster of claim 1 wherein said user-operated means includes a pedal to be engaged by the user's foot.

3. The vacuum cleaner nozzle front wheel height adjuster of claim 1 wherein said user-operated means includes means for releasably retaining said cam means in any one of a plurality of different adjusted positions whereby said front wheels are correspondingly retained at any one of a plurality of different heights.

4. The vacuum cleaner nozzle front wheel height adjuster of claim 1 wherein said lifter defines a U-shaped portion slidable longitudinally on said support leg.

5. The vacuum cleaner nozzle front wheel height adjuster of claim 1 wherein said means movably mounting said lifter comprises an arm having a rear portion mounted to said housing and a front portion slidably engaging said lifter.

6. The vacuum cleaner nozzle front wheel height adjuster of claim 1 wherein said means movably mounting said lifter comprises a resilient arm having a rear portion mounted to said housing and a front portion slidably engaging said lifter.

7. The vacuum cleaner nozzle front wheel height adjuster of claim 1 wherein said cam means is arranged to be spaced from said cam follower to permit said nozzle to be disposed in a lowermost position.

8. In a vacuum cleaner nozzle having a housing defining an air suction passage, rear wheels for supporting a rear portion of the housing for rolling movement of the nozzle on a subjacent surface to be cleaned, and a U-shaped front wheel assembly including a support having a rear bight pivotally mounted to the housing, a pair of forwardly extending legs, and wheels rotatively carried on a forward distal end portion of said legs to rollingly engage the subjacent surface forwardly of said rear wheels, an improved front-wheel height adjuster comprising:

a lifter bodily translatably engaging a leg of said support forwardly of said bight;

means movably mounting said lifter to a portion of the housing; and means movably carried by the housing for selectively translating said lifter relative to said support leg including a user-operated ratchet means for swinging said support about the axis of said bight to selectively raise and lower the front wheels and thereby adjust the angular disposition of the nozzle housing relative to said subjacent surface.

9. In a vacuum cleaner nozzle having a housing defining an air suction passage, rear wheels for supporting a rear portion of the housing for rolling movement of the nozzle on a subjacent surface to be cleaned, and a U-shaped front wheel assembly including a support having a rear bight pivotally mounted to the housing, a pair of forwardly extending legs, and wheels rotatively carried on a forward distal end portion of said legs to rollingly engage the subjacent surface forwardly of said rear wheels, an improved front-wheel height adjuster comprising:

a lifter movably connected to a leg of said support forwardly of said bight;

means movably mounting said lifter to a portion of the housing; and means movably carried by the housing for selectively moving said lifter including a user-operated ratchet means for swinging said support about the axis of said bight to selectively raise and lower the front wheels and thereby adjust the angular disposition of the nozzle housing relative to said subjacent surface, said ratchet means comprising a lever pivotally mounted to the housing and having a foot pedal actuation portion, a ratchet wheel rotatably mounted to the housing and having notches and ratchet teeth, a cam rotatable with said ratchet wheel, means responsive to a depression of said foot pedal actuation portion of the lever for selectively engaging said ratchet teeth to advance the ratchet wheel a rotational step as an incident of each depression of the foot pedal actuation portion and a cam follower connected to said lifter for selectively moving the lifter in accordance with the rotational position of said cam.

10. The vacuum cleaner nozzle front wheel height adjuster of claim 9 wherein said cam is arranged to cause said cam follower to move the lifter incrementally to provide a plurality of successively greater wheel height adjustments and a subsequent return to a minimum wheel height adjustment as a result of step-by-step rotational advance of the ratchet wheel by said foot pedal actuation portion of the lever.

11. The vacuum cleaner nozzle front wheel height adjuster of claim 9 wherein said cam is arranged to cause said cam follower to move the lifter incrementally to provide a plurality of successively greater wheel height adjustments and a subsequent return to a minimum wheel height adjustment as a result of step-by-step rotational advance of the ratchet wheel by said foot pedal actuation portion of the lever, said cam being arranged to cause two series of said successive wheel height adjustments for each 360° rotation of the ratchet wheel.

12. The vacuum cleaner nozzle front wheel height adjuster of claim 9 wherein said cam is arranged to cause said cam follower to move the lifter incrementally to provide a plurality of successively greater wheel height adjustments and a subsequent return to a minimum wheel height adjustment as a result of step-by-step rotational advance of the ratchet wheel by said foot pedal actuation portion of the lever, and means for releasably retaining the ratchet wheel in each of the successive advanced rotational positions thereof.

13. The vacuum cleaner nozzle front wheel height adjuster of claim 9 wherein said cam is arranged to cause said cam follower to move the lifter incrementally to provide a plurality of successively greater wheel height adjustments and a subsequent return to a minimum wheel height adjustment as a result of step-by-step rotational advance of the ratchet wheel by said foot pedal actuation portion of the lever, and means for releasably retaining the ratchet wheel in each of the successive advanced rotational positions thereof comprising a resilient tooth for releasably engaging each of said notches of the ratchet wheel.

14. The vacuum cleaner nozzle front wheel height adjuster of claim 9 wherein said cam is arranged to cause said cam follower to move the lifter incrementally to provide a plurality of successively greater wheel height adjustments and a subsequent return to a minimum wheel height adjustment as a result of step-by-step rotational advance of the ratchet wheel by said foot pedal actuation portion of the lever, said notches comprising peripheral notches on the ratchet wheel, said means for releasably retaining the ratchet wheel in each of the successive advanced rotational positions thereof comprising a resilient tooth for releasably engaging each of said notches of the ratchet wheel.

15. The vacuum cleaner nozzle front wheel height adjuster of claim 9 wherein said said cam is arranged to cause said cam follower to move the lifter incrementally to provide a plurality of successively greater wheel height adjustments and a subsequent return to a minimum wheel height adjustment as a result of step-by-step rotational advance of the ratchet wheel by said foot pedal actuation portion of the lever, said notches comprising peripheral notches on the ratchet wheel, said means for releasably retaining the ratchet wheel in each of the successive advanced rotational positions thereof comprising a resilient tooth for releasably engaging each of said notches of the ratchet wheel, and said ratchet teeth comprising teeth projecting parallel to the axis of rotation of the ratchet wheel.

16. The vacuum cleaner nozzle front wheel height adjuster of claim 9 wherein said cam is arranged to cause said cam follower to move the lifter incrementally to provide a plurality of successively greater wheel height adjustments and a subsequent return to a minimum wheel height adjustment as a result of step-by-step rotational advance of the ratchet wheel by said foot pedal actuation portion of the lever, said notches comprising peripheral notches on the ratchet wheel, said means for releasably retaining the ratchet wheel in each of the successive advanced rotational positions thereof comprising a resilient tooth for releasably engaging a selected one of said notches of the ratchet wheel, and said ratchet teeth comprising teeth projecting parallel to the axis of rotation of the ratchet wheel, said means responsive to a depression of the lever comprising second teeth having releasable sliding engagement with said ratchet teeth and means for resiliently biasing said second teeth toward said ratchet teeth.

* * * * *